US005228773A

United States Patent [19]

Win

[11] Patent Number: 5,228,773

[45] Date of Patent: Jul. 20, 1993

[54] WIDE ANGLE LIGHT DIFFUSING LENS

[75] Inventor: Murray M. Win, Beverly Hills, Calif.

[73] Assignee: Malcolite Corporation

[21] Appl. No.: 775,576

[22] Filed: Oct. 15, 1991

[51] Int. Cl.[5] ..... F21V 5/02

[52] U.S. Cl. ..... 362/339; 362/330; 362/223

[58] Field of Search ..... 362/147, 223, 310, 329, 362/330, 355, 339

[56] References Cited

U.S. PATENT DOCUMENTS

| | | | |
|---|---|---|---|
| 3,249,752 | 5/1966 | Odle | 362/339 |
| 3,275,822 | 9/1966 | Wince et al. | 362/223 |
| 4,262,326 | 4/1981 | Lewin | 362/223 |
| 4,462,068 | 7/1984 | Shadwick | 362/339 X |

*Primary Examiner*—Stephen F. Husar
*Attorney, Agent, or Firm*—Robert J. Schaap

[57] ABSTRACT

A light diffusing lens for location in and extending across a downwardly facing light emitting opening of a light fixture of the type having a recessed light source. The lens comprises a lip such as a horizontally disposed peripherally extending lip supporting the lens at the opening. A somewhat vertically disposed first light translucent wall, which is preferably rectangularly shaped, extends downwardly from the lip and permits light from the light source transmitted through this somewhat vertical wall to be directed horizontally, downwardly and upwardly. A pair of inwardly converging second light translucent side walls extend downwardly from the first light translucent wall and have upper edges connected to a lower edges of the first wall. The lower edges of this pair of side walls are joined to form a closed lower end. A pair of inwardly converging end walls are connected to the side walls and also join at the closed lower ends. The exterior surfaces of all of the walls are provided with a prismatic surface configuration. Furthermore, the various walls of the lens effectively form a prismatically shaped lens. The light diffusing lens of the invention thereby permits dispersion of light from planes at a wide angle.

28 Claims, 4 Drawing Sheets

WIDE ANGLE LIGHT DIFFUSING LENS

BACKGROUND OF THE INVENTION

1. Field of the Invention

This invention relates in general to certain new and useful improvements in light diffusing lenses for light fixtures, and more particularly, to an improved light diffusing lens which permits a wide angle of light dispersion thereby permitting a dispersion of light with a resultant lighting of areas previously uncovered by dispersion of light with prior art light diffusing lenses.

2. Brief Description of the Prior Art

Most light fixtures used in overhead lighting environments and particularly, most overhead fluorescent light fixtures are generally constructed of a metal frame having a downwardly facing opening which usually receives and is enclosed by a conventional light dispensing lens. In some cases, the fixture has a lower surface which is flush with a ceiling and in other constructions, the fixture may extend downwardly from the ceiling by a relatively small dimension. However, fixtures which are typically constructed of metal or plastics, are opaque to light and are designed only for light distribution from the downwardly facing light emitting opening.

The conventional light diffusing lens or so-called "diffuser" typically comprises a flat sheet such as a plastic sheet, which is supported by an inwardly struck peripheral rim at the periphery of the light fixture. Thus, the lens is usually co-planar with the surface of the ceiling. The actual source of the light, such as fluorescent lamps, are generally recessed above the surface of the lens.

It is conventionally believed that in order to obtain optimum light efficiency in a given area, such as a room, most light from an overhead light fixtures should be directed downwardly. As a result, no effort is made to direct light to the ceilings or upper portions of the side wall of a given space such as a room. With a given size light source, it is generally assumed that light dispersion should occur at angles of no greater than 45° from the vertical planes at the edge of a light fixture. Therefore, the overall included angle of light dispersion from many overhead light sources is about 90°. In some cases, light dispersion did occur at about 65° outwardly from plans at each of the vertical edges of the lens. Thus, and in these cases, maximum light dispersion is about 130°. In either case, whether light disperses at angles of 45° with respect to vertical planes at the edges of the lens, or 65°, it is apparent that upper portions of a room and most of the ceiling remains unlighted, except by reflected light. As a result, there is relatively low lighting levels on the ceiling and upper portions of the vertical walls of a room.

Generally, all prior art lenses utilize a relatively thin sheet of plastic material, such as an acrylic plastic, which is translucent as to somewhat cloud or hide the fluorescent lamps. However, since the lens is very closely spaced with respect to the lamps, there is usually a harsh strong light emanating from the light fixture. Many light dispensing lens producers attempt to use a stippled outer surface. However, even the stippled outer surface does not fully reduce the harshness of the light and further, does not provide any greater light distribution than a non-stippled outer surface. There are some attempts to also use a lens having a prismatic surface effect. However, and here again, the lenses all comprise a relatively flat sheet located at the face of the structure.

There have been attempts to use light diffusing lenses with linear serrations for purposes of directing light. Generally, this attempt to use linear serrations resided in a lens having a peripherally-extending vertical wall along with a flat bottom wall. The vertically-extending peripheral wall had linear serrations with surfaces directed downwardly so that the light passing through the vertical wall was, in effect, directed downwardly. Clearly, light from the bottom wall would be directed downwardly with some side dispersion as for example, at angles of 45° to 65° from the edges of the lens. However, here again, this type of lens was primarily constructed so as to ensure a large concentration of downwardly directed light with very little interest in lighting areas other than those immediately beneath the light.

Most conventional light fixtures have a relatively short vertical depth, that is, vertical dimension, often times due to the fact that there is only a limited amount of space in the ceiling area in which a light fixture is mounted. Thus, the conventional lenses which are now used are in the nature of a flat sheet and are located in very closely spaced relationship to the light source, such as the fluorescent lamps. As a result, the light which is dispersed from the conventional light fixture is usually relatively harsh. Moreover, one looking into a light fixture through the light translucent lens can almost always observe the lamps and the sockets of that fixture.

Harsh lighting condition has a particularly pronounced effect on work stations where one must use a computer screen or otherwise examine information on any other type of raster pattern screen. This harsh lighting condition results in a so-called "glare" on the screen of the computer generating considerable eye fatigue. There have been many attempts to produce computer screens which reduce the amount of glare. However, it has also been found that in an attempt to reduce glare, resolution of the screen is also concomitantly reduced. Consequently, there is a need to control the overall lighting environment of a room or other work area in which computers and similar raster pattern screens are being employed.

Heretofore, there has not been any effective lens for use with an overhead light fixture which provides a very wide angle light distribution and effectively permits the generation of a soft light condition in an entire room environment without sacrificing light efficiency and which also permits substantial light generation without glare.

OBJECTS OF THE INVENTION

It is, therefore, one of the primary objects of the present invention to provide a light diffusing lens which is capable of providing of a wide degree of light distribution with generally uniform light dispersion to essentially all portions of and throughout a lighted area.

It is another object of the present invention to provide a light diffusing lens of the type stated which permits a almost circular light generation pattern so as to effectively light all portions of a given space with a ceiling mounted light fixture and which reduces glare and shadows.

It is an additional object of the present invention to provide a light diffusing lens of the type stated which creates an effect of complete and full lighting of a selected environment without increasing the lumen output.

It is a further object of the present invention to provide a light diffusing lens of the type stated which is capable of reducing glare on a computer screen and which still maintains adequate light distribution at a computer work station.

It is yet another salient object of the present invention to provide a light diffusing lens of the type stated which is highly efficient in operation and which can be constructed at a relatively low cost.

With the above and other objects in view, my invention resides in the novel features of form, construction, arrangement and combination of parts presently described and pointed out in the claims.

BRIEF SUMMARY OF THE DISCLOSURE

A light diffusing lens for disposition over a light dispensing opening of a light fixture. Generally, the light diffusing lens of the invention is used in overhead light fixtures which may be mounted within or suspended from the ceiling structure of a room. In each case, the light fixture has means for providing a source of light such as, for example, one or more fluorescent lamps located above a downwardly facing light dispensing opening.

As indicated previously, in the prior art light diffusing lenses, a generally flat sheet, such as an acrylic sheet, was employed. It was generally assumed, as aforesaid, that light should be directed downwardly with dispersion occurring at no more than about 45° from vertical planes at the edges of the light fixture. Generally, little or no attempt was made to create light distribution on upper portions of walls of a room or on the ceiling of a room or other areas which were not immediately accessible to an overhead light. In fact, there was no light fixture or lens which was capable of providing a wide degree of light distribution efficiently without increasing the light output and hence, the energy consumption involved.

In connection with the present invention, it has now been recognized that a room with a substantially equal light distribution across all portions of the room including upper portions of the walls and the ceiling has an effect on the occupant of being a better lighted room. The light distribution of the light dispensing lens of the present invention eliminates low-intensity lighted areas and dark spots. Furthermore, there is not necessarily any area which would have a specific high-light intensity and others with reduced light intensity so as to create the overall uneven light distribution in a room.

Tests have been conducted with the lens of the present invention and personnel using a particular room with the lens of the invention believe that there is much more light available at a given work station, even though a room has substantially equal light distribution across all portions of that room, and even when there is no increase in light output. Thus, the invention clearly provides an improved psychological effect on the occupants of a room when there is an even and substantially wide light distribution.

The light diffusing lens of the present invention comprises some means for supporting the lens at the downwardly facing opening of a light fixture. The supporting means may preferably adopt the form of a peripheral flange which engages and is supported by the inwardly extending peripheral lip of the light fixture. The lens may also comprise a first light translucent wall, as for example, a generally vertically arranged light translucent wall which extends outwardly from the supporting flange. Thus, in the case of an overhead light fixture, the first wall extends downwardly from the supporting flange.

Since the first light translucent wall is generally vertically arranged, it causes light to be directed at an angle substantially parallel to the plane of the light dispensing opening o the light fixture and will also cause light to be directed at substantial angles with respect thereto. Thus, when light projects from the first light translucent wall, this light will effectively create an even light distribution across the ceiling almost immediately adjacent the light fixture and direct light will also be directed to the vertical walls including upper portions thereof and also downwardly to a lower portion of the room.

A pair of inwardly inclined second-light translucent walls are connected to lower edges of the first walls and are operatively connected together for causing light from the source of light to be directed both generally perpendicular to the plane of the light dispensing opening and at substantial angles thereto such as for example 85° angles from planes at the edges of the walls so that the light is also directed generally parallel to the plane of the opening.

The second light translucent walls are effectively side walls which connect together at outer lower edges. A pair of translucent end walls, or so-called "third walls", are dependent from the peripherally extending first wall and connected to the side walls. The outer edges of the second walls or side walls are connected together and form a single elongate outer-most edge of the lens and the third walls are connected to the second walls and to this single elongate outer-most edge.

The pair of side walls or so-called "second walls" have formed the elongate lower edge, as aforesaid, and are inclined at a substantial angle with respect to a vertical plane. The end walls are also located at a substantial angle and effectively enclose the ends of the side walls. Thus, the lens itself adopts somewhat of a prismatic configuration which aids in obtaining a very wide light distribution.

Inasmuch as the side walls and the ends walls or so-called "third walls" are spaced downwardly from the peripherally extending first wall, they form a substantial pocket between the sources of light such as the fluorescent lamp and the outer surface of the lens. As a result, there is no harsh light distribution. In fact, when a normal wattage lamp is used, it is exceedingly difficult, if not virtually impossible, to recognize the outline of the lamps through the lens.

The surface of the plastic sheet material which is used to form the lens in accordance with the present invention is provided with a prismatic outer surface. Moreover, four-sided prisms extend across the entire surface area of the sheet and are located exteriorally of the light fixture. It should be understood that six-, eight- and twelve-sided prisms could also be employed, if desired. However, the four-sided prism surface configuration on the various walls of the lens has been found to be highly effective in connection with the present invention.

The lens of the present invention is formed in a special operation which is more fully illustrated and described in a copending patent application. However, when forming the lens of the present invention, heat is employed. When a plastic sheet is heated to form the instant lens, many of the rows of pyramids on the seat surface become distorted and are effectively arcuately shaped. Thus, if one examines the rows of pyramid sections on portions of a sheet surface, an arcuately-shaped pattern will become apparent. Furthermore, many of the various prism elements themselves also become distorted in shape. This has been found to lead to a very irregular and wide light distribution pattern resulting in an almost thoroughly even light distribution across an entire given area.

The lens of the invention can actually be considered to be sculptured. Not only are the various prisms altered in shape so that many of the prisms will differ from other of the prisms, many of the rows or columns of prisms are also altered. In addition, the walls of the lens are located at angles relative to one another and are not merely extruded or otherwise formed as a flat planar sheet in a plastics molding operation.

The heat which is used to form the lens actually causes a tempering of the lens and thus, increases its impact resistance. As a result, the lens of the present invention is not as brittle as the conventional prior art lens, and it also withstands the abuse to which lenses of this type are normally subjected.

The invention has many other purposes and other advantages which will be made more fully apparent from a consideration of the forms in which it may be embodied. One of these forms of the unique and novel light dispensing lens is disclosed in the following detailed description of the invention and is illustrated in the drawings accompanying this present specification. However, it should be understood that this detailed description and the drawings are set forth only for purposes of illustrating the general principles of the invention and that the invention is not to be taken in a limiting sense.

DETAILED DESCRIPTION OF A PREFERRED EMBODIMENT

Figure 1:
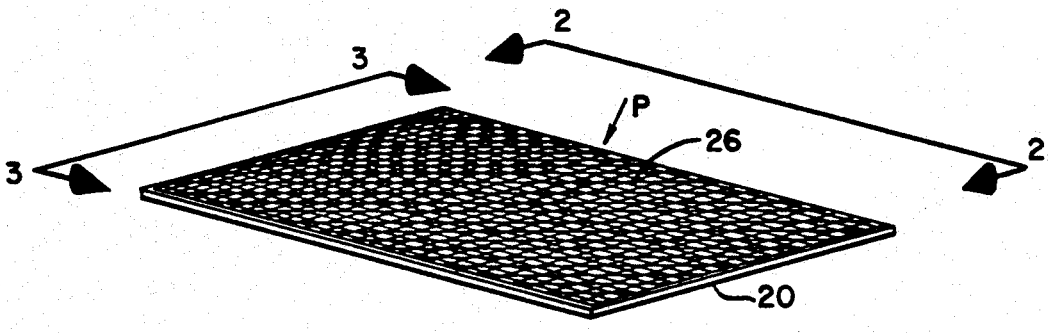
FIG. 1 PRIOR ART
FIG. 1 is a perspective view of a prior light art diffusing lens in an inverted position for purposes of clarity.

Referring now in more detail and by reference characters to the drawings which illustrate a preferred embodiment of the present invention, reference will first be made to FIGS. 1–4 of the drawings which illustrate a prior art light diffusing panel or lens P. This light diffusing lens P is illustrated and described briefly herein for purposes of showing the differences between and the improvement created by the light diffusing lens of the present invention.

The prior art light diffusing or so-called "light dispersing" lens P generally comprises a flat sheet 20 which is formed of a light translucent material, such as an acrylic plastic. The materials of construction used in the formation of a lens P varies in accordance with prior art teachings, although generally all such lenses are either translucent or transparent and they are preferably translucent.

Figure 2:
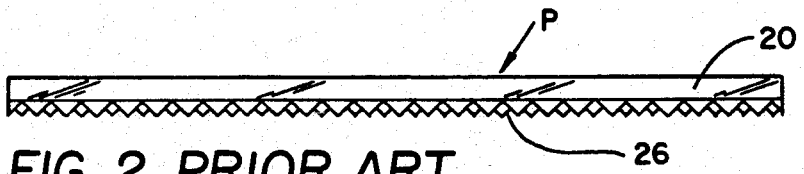
FIG. 2 PRIOR ART
FIG. 2 is a side elevational view of the light diffusing lens of FIG. 1, taken substantially along the plane of line 2—2 of FIG. 1 and in a normal position of use.
Figure 3:
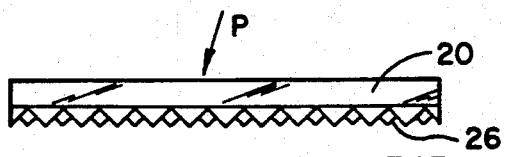
FIG. 3 PRIOR ART
FIG. 3 is an end elevational view of the prior art light diffusing lens of FIG. 1, taken substantially along the plane of line 3—3 of FIG. 1 and in a normal position of use.

The sheet 20 may be provided on one of its surfaces and preferably its downwardly presented surface 22 with a stippled surface texture. In some cases, the prior art light diffusing lens had a somewhat prismatic surface configuration 24, as best illustrated in FIGS. 2 and 3 of the drawings. This prismatic surface 24 is more fully shown in enlarged detail in FIGS. 4 and 5 of the drawings. As indicated previously, the sheet 20 is inverted with respect to its normal position of use, in FIG. 1, in order to more fully illustrate the actual surface configuration of the sheet.

Figure 5:
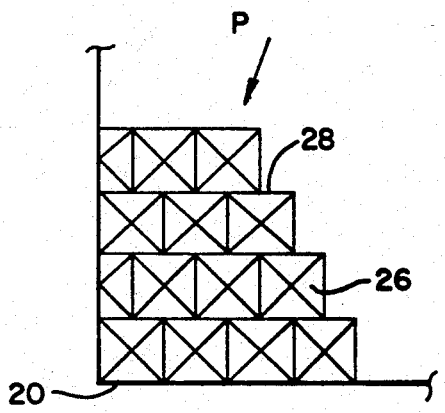
FIG. 5 PRIOR ART
FIG. 5 is a top-plan view of the light diffusing lens as illustrated in FIG. 4.
Figure 4:
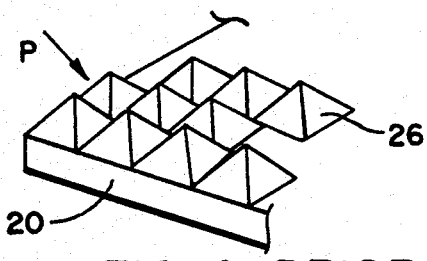
FIG. 4 PRIOR ART
FIG. 4 is a fragmentary perspective view in an inverted position for purposes of clarity showing a corner portion of the prior art light diffusing lens in enlarged detail.

By further reference to FIGS. 4 and 5, it can be seen that the surface of the sheet is comprised of elongate rows and columns of pyramid-like or diamond-shaped projections 26 and each of the rows and columns of pyramid-like projections 26 are separated by grooves or troughs 28. In each case, it can be observed that the troughs or grooves 28 are generally linear and that the projections 26 also lie in linear rows and columns, although not perpendicular to the edges of the sheet.

Figure 6:
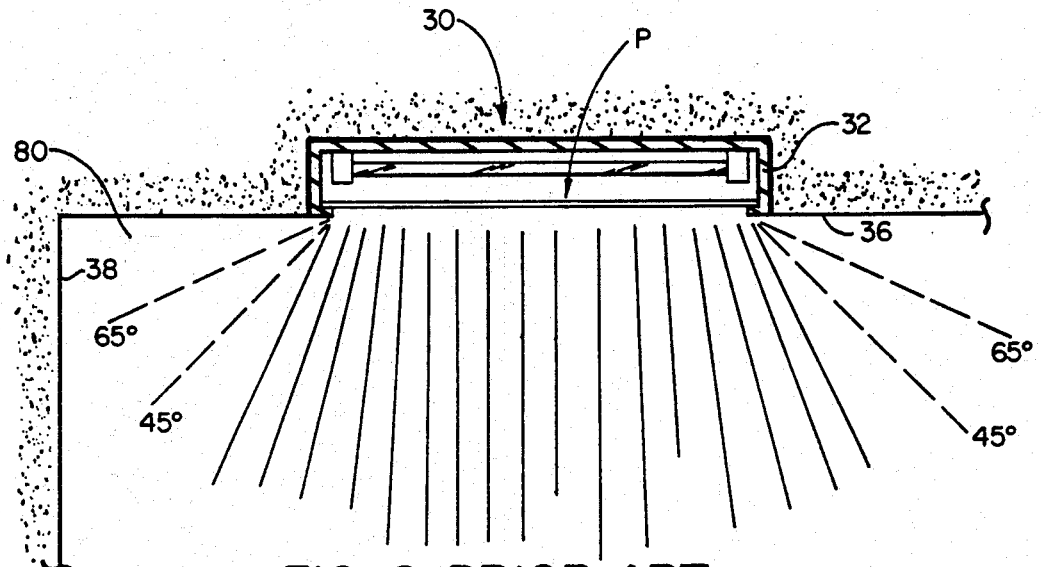
FIG. 6 PRIOR ART
FIG. 6 is a schematic side elevational view showing a light distribution pattern of a prior art lens mounted in a downwardly opening fixture.

By reference to FIG. 6, it can be observed that the prior art lens P is used in a conventional light fixture 30 which comprises an outer metal housing 32, having a source of light, such as one or more fluorescent lamps 34. While the lens P is spaced somewhat downwardly from the light source 34, it can be observed in normal practice therein, usually a very small distance exists between this light source and the lens P.

By further reference to FIG. 6, it can be observed that light is directed downwardly and extends outwardly from a vertical plane passing through the opposite edges of the lens P at an angle of about 45°. The light could also possibly extend to an angle of 65° depending upon the construction of the lens which is used. However, it can be observed that the ceiling 36 is unlighted, at least by direct light. The same holds true with respect to an upper portion of a wall 38 as illustrated in FIG. 6. Thus, there is a strong concentration of light directly downwardly and at angles of 45° with respect to the vertical. However, any light which may impinge upon the ceiling or the wall portion 38 is only as a result of reflected light.

It has been found in the present invention that while there is no need to maintain high intensity light distribution on a ceiling or on upper portions of vertical walls of a room, the fact that there are light and dark spots in a room has a noticeable psychological effect on the people that use and work in that room.

Generally, it is now recognized with this invention that a room with a substantially equal light distribution across all portions of the room is a much better lighted room than a room which has well lighted areas and low intensity lighted areas and perhaps some dark spots, even though the personnel in that room may work in an area which is of high light intensity. Tests have been conducted and personnel working in a room environment generally believe that there is more light available at their work station if a room has substantially equal light distribution across all portions of a room, then when there are areas of unequal light intensity.

FIGS. 7 through 14 more fully illustrate one of the preferred light diffusing lenses L constructed in accordance with and embodying the present invention. This light diffusing lens L may preferably be rectangular in top-plan view in the manner a best illustrated in FIG. 7 of the drawings. However, the exact shape and size will vary depending upon the size and the shape of the fixture in which the light diffusing lens L may be employed. Thus, and for this purpose, the light diffusing lens could be constructed so that it is triangular in horizontal cross-sectional shape, octagonal in horizontal cross-sectional shape, etc.

The materials used in the formation of the light diffusing lens L are essentially the same material which may be used in the formation of the prior art light diffusing lens P. Thus, and in a preferred embodiment, the acrylic resins such as methyl-acrylate and methyl-methacrylate are widely used. Further, co-polymers of the acrylates are often employed. Nevertheless, essentially any light translucent material which is capable of diffusing light when passing therethrough may be used in the formation of the lens L.

By reference to FIGS. 7–10, it can be observed that the lens L, in the illustrated and described embodiment, is generally rectangular in shape. The lens L comprises a horizontally disposed peripherally extending rectangularly shaped supporting flange or so-called lip 40 which is adapted to rest upon and seat on a peripheral inwardly struck supporting flange surrounding a downwardly facing opening of a light fixture, (FIG. 15), such as the fixture 30 illustrated in FIG. 6 of the drawings. In this case, the fixture 30 provided with an inwardly struck retaining flange 42 which is adapted to receive and engage the lip 40 with the lens L on its upper surface. Further, this flange 42 forms the outer edge of a downwardly facing, light emitting opening which is covered by the lens L.

Figure 8:
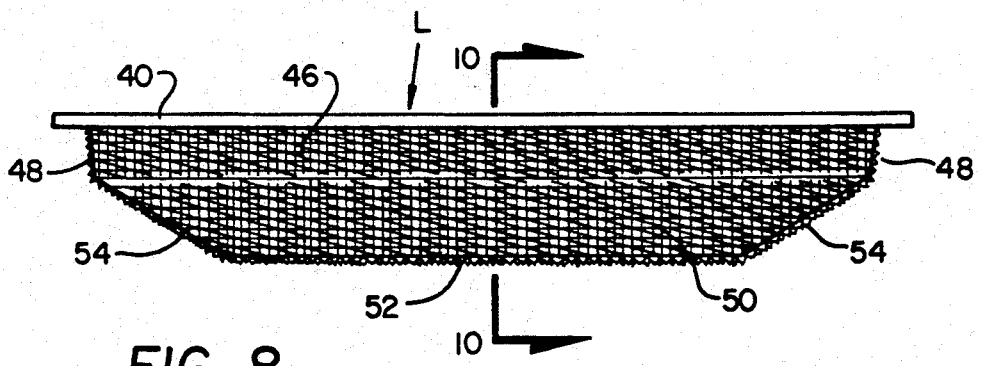
FIG. 8 is a side elevational view of the light diffusing lens of FIG. 7.
Figure 9:
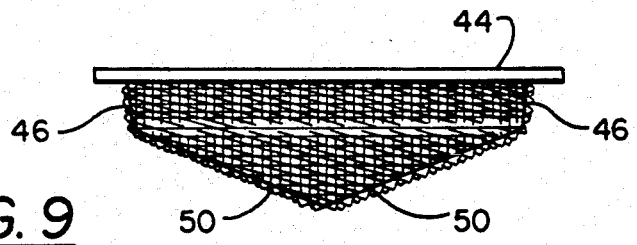
FIG. 9 is an end elevational view of the light diffusing lens of FIG. 7.
Figure 10:
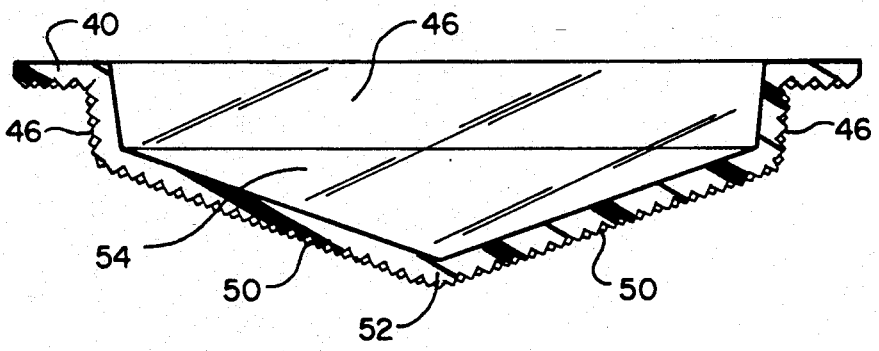
FIG. 10 is a vertical sectional view taken substantially along line 10—10 of FIG. 8.

Extending downwardly from the lip 40 is a generally rectangularly shaped first light translucent wall 4 which is comprised of a pair of longitudinally extending first side wall sections 46 and a pair of transversely extending first side wall sections 48, as also best illustrated in FIGS. 8 through 10 of the drawings. Each of the side wall sections 46 and 48 are generally vertically located with respect to the lip 40, although they may be slightly angulated from a vertical plane by an angle which does not exceed about 10°, and preferably does not exceed about 5°, with respect to a vertical plane. Thus, and for the purposes of this invention, a side wall panel such as a side wall section 46 or 48, may be located at an angle as much as 10° with respect to a vertical plane and which is still considered generally vertical with respect to the present invention.

Extending inwardly from the lower edges of the first side wall sections 46 are a pair of side wall panels, or so-called "second" walls, 50 and which are joined at a lowermost edge 52. Each of the side wall panels 50 are integral with the longitudinally extending generally vertical side wall sections 46, as best illustrated in FIGS. 8–10 of the drawings and the two side wall panels 50 are integral with one another at the joinder line of the edge 52. The side wall panels 50 are angulated with respect to a vertical plane at an angle of about 45° to about 75° although this angle may vary with respect to a vertical plane from about 10° to about 35°. The most preferred angle of each of the second side wall panels 50 is about 70° with respect to a true vertical plane.

Figure 7:
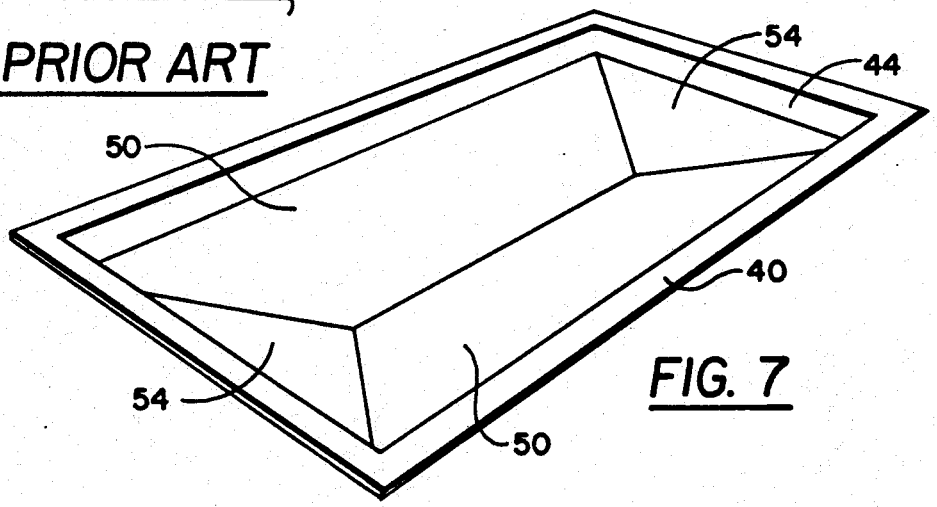
FIG. 7 is a perspective view of a light diffusing lens constructed in accordance with and embodying the present invention.

Connected to the lower edges of the transversely extending generally vertical side wall sections 48 are a pair of spaced apart transversely extending pair of end walls panels or walls 52 or so-called third walls and which are triangularly shaped, as best illustrated in FIGS. 7 and 10 of the drawings. Each of the end wall panels 54 also extend inwardly at an angle ranging from about 45° to about 75°. However, the most preferred angle with respect to a vertical plane for the end wall panels 54 is about 50° to about 75°. It can be observed that the lower end of each triangularly shaped end wall panel 54 is connected to the joinder line of the lower edge 52 between the longitudinally extending panels 50, again, as best illustrated in FIG. 7 of the drawings.

The lens L of the present invention is also provided with a prismatic outer surface 60 which is best illustrated in FIGS. 10–14 of the drawings. This prismatic outer surface 60 is somewhat similar to the prismatic outer surface in the prior art panel light diffusing lens P, in that each may contain four-sided pyramid-like prisms 65. However, in the present invention, pyramid-shaped projections 62 or prisms on the outwardly presented surface of the lens L form somewhat arcuately shaped columns 64 over their length. Thus, by reference to FIGS. 11 and 12, it can be observed that the troughs or grooves 66 between each of the projections 62 is not linear as in the case of the prior art panel P. Although the reason is not fully understood, it is believed that in the formation process, due to uneven bending, the rows of plastic prisms assume a shape somewhat similar to that illustrated in FIGS. 11 and 12. Nevertheless, this has been found to be quite beneficial in that it literally creates a better distribution of light by using an irregular prism pattern, as opposed to the regular prism pattern in the prior art lens P.

Figure 11:
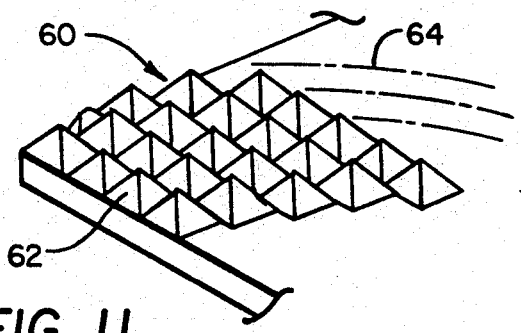
FIG. 11 is an enlarged perspective view, in an inverted position for purposes of clarity, and showing a corner portion of the light diffusing lens constructed in accordance with and embodying the present invention.
Figure 12:
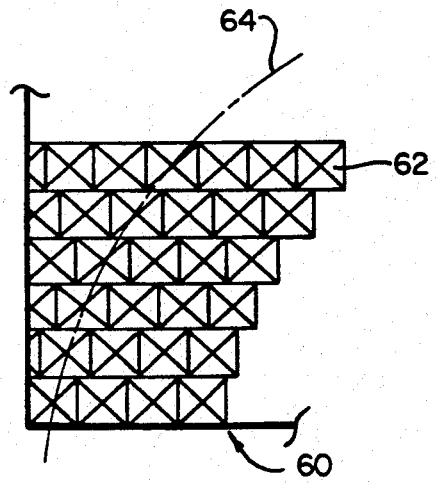
FIG. 12 is a top-plan view of the portion of the light diffusing lens as shown FIG. 11.

The rows of prisms 65 only have a slight arcuate shape, as best illustrated by reference to FIGS. 11 and 12. Moreover, while the arcuate rows have been illustrated as having a regular arcuate shape, the shape could be slightly irregular. Moreover, the radius of curvature in the various rows could also vary somewhat. In essence, it has been found that while portions of the sheet do assume arcuately-shaped rows of prisms, other portions of the sheet may still have linear rows of prisms. The radius of curvature of the rows of prisms will probably vary depending upon the amount of heating and the degree of bending which takes place in an initially flat sheet to form the lens L of the present invention.

Figure 13:
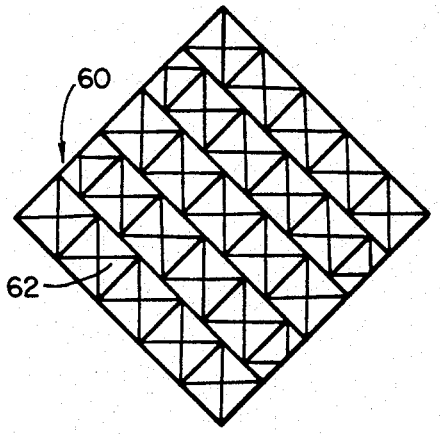
FIG. 13 is an enlarged top-plan view showing prismatic surface arrangement on a sheet of plastic material.
Figure 14:
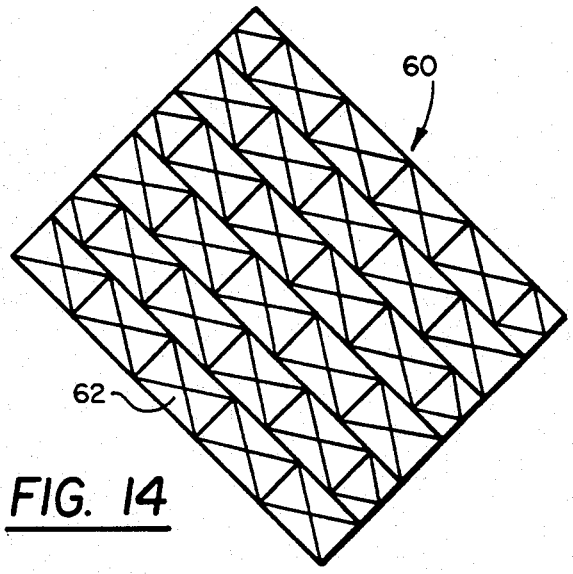
FIG. 14 is a top plan view, somewhat similar to FIG. 13 and showing the prismatic surface arrangement after formation of the lens of the present invention.

Referring now to FIGS. 13 and 14, which illustrate prism sections on the exterior surface of the lens, it can be observed that in some portions of the lens, the prisms have a regular shape as illustrated in FIG. 13. In other words, the prisms have a somewhat diamond-shaped appearance in top-plan view and all sides thereof are equilateral and equiangular. However, in some portions of the lens L, the prisms are actually stretched, as best illustrated in FIG. 14. In this case, the prisms assume somewhat of a an orthagonal and particularly trapezoidal shape with longer lengths than widths. Here again, it is believed that this shape results from the heating and bending of the initially flat sheet to form the lens L of the invention.

The distortion in the prisms 62 also lends to a wider distribution of light. Thus, the arcuately-shaped rows of prisms, as well as the distorted diamond-shaped pattern or so-called stretched patterns of prisms, cooperate to provide an even higher degree of light dispersion.

Figure 15:
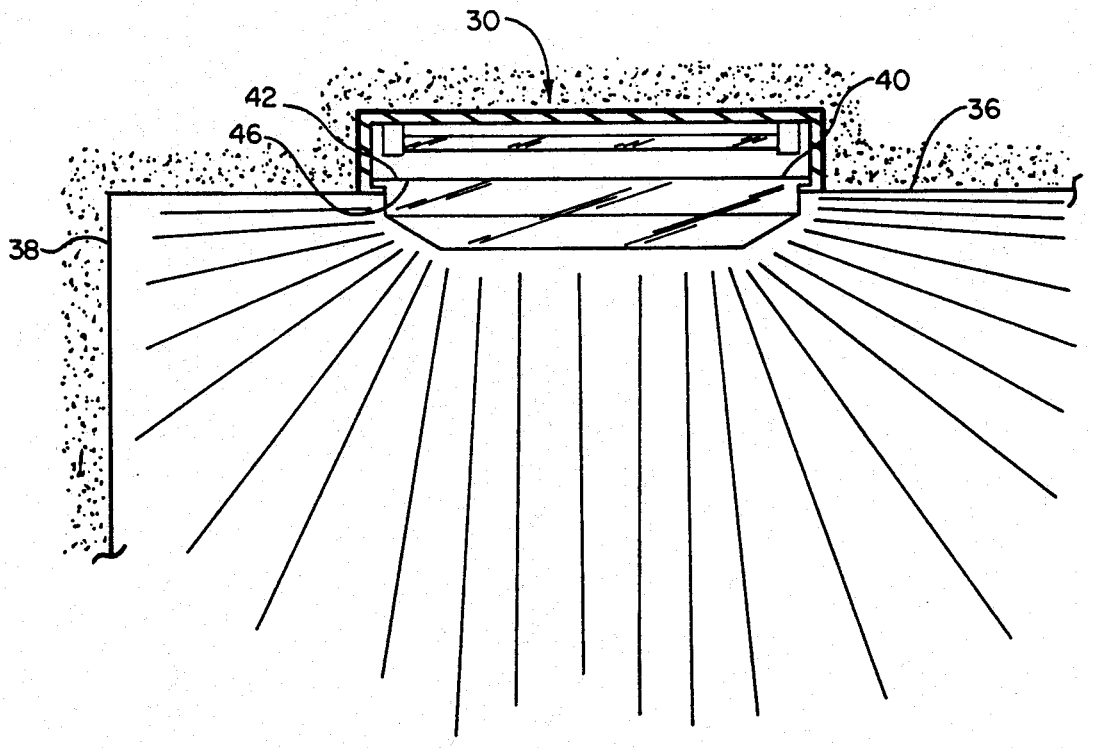
FIG. 15 is a schematic side elevational view showing the light distribution pattern of a light diffusing lens of the present invention in a downwardly facing opening of a light fixture.

FIG. 15 more fully illustrates the light distribution patterns achieved when using the lens L of the present invention in a light fixture. When the lens L is employed in a light fixture, it can be observed that light will spread outwardly at least in a generally horizontal direction from the first generally vertical wall 44 including the first wall sections 46 and 48. Thus, it can be seen, by reference to FIG. 16, that light emanates from the first wall sections 46 in generally horizontal rays and will clearly illuminate the ceiling 36 of a room along with an upper portion of the side wall 38. Moreover, these areas are illuminated by direct light and not by reflected light as in the case of the prior art lens P. In addition, it can be observed that light will also pass through the side wall panels 50 and the end wall panels 54 to create an almost complete distribution of light to all portions of a room in which the overhead light fixture and the associated lens L of the invention are employed.

Figure 16:
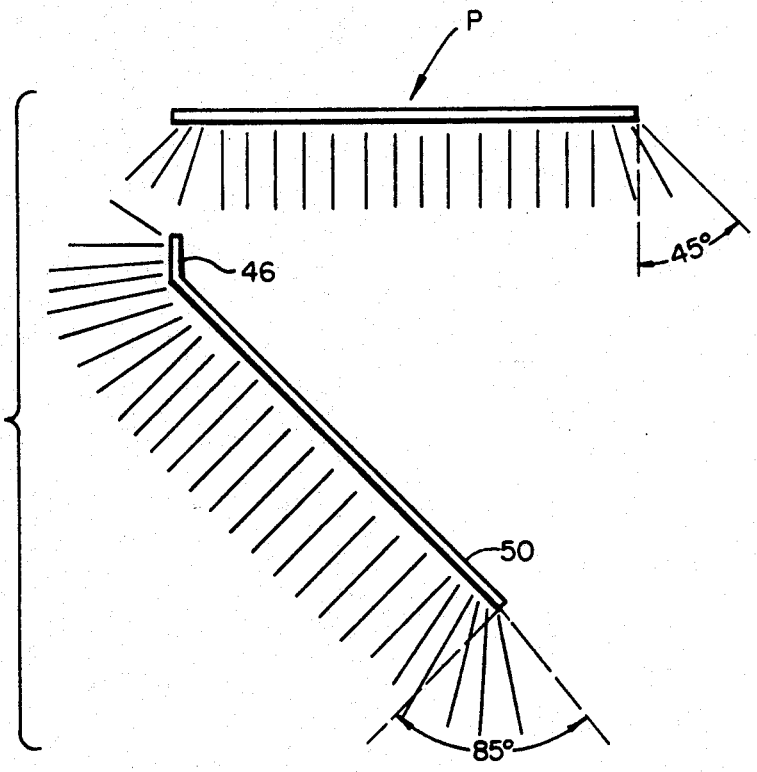
FIG. 16 is a schematic view showing a light distribution pattern from a horizontally located prior art lens and a light distribution pattern from one of the walls of the light fixture of the present invention.

FIG. 16 more fully illustrates the effect of the panels in the lens L of the present invention compared to a prior art panel P. It can be observed that with the prior art lens P, as illustrated in FIG. 16, light is directed downwardly and to some extent, to the sides of the panels at angles of about 45° and possibly even 65°. However, not only is light directed at an angle of about 85° from the panel of the present invention, but the panels 50 and 54 are actually rotated with respect to a horizontal plane. Thus, light emanates from these panels at an inclusive angle in excess of 180°. In fact, by placement of the various panels in the arrangement as illustrated, there is an actual distribution which far exceeds 180°. In other words, the light source using the lens of the present invention actually operates as though it was providing a completely circular pattern of light.

It can be observed by comparing FIGS. 6 and 15 that there are effectively dark spots 80 where light passing outwardly from the lens P does not radiate, except in the case of any reflection from a reflective surface. Assuming no reflective surface exists in the room or environment in which the fixture F is located, then dark spots such as those at 80 will exist.

In accordance with the present invention, it can be observed that light floods the entire ceiling are immediately adjacent the fixture 30 and extends outwardly therefrom to illuminate corner portions of a ceiling 36 and a vertical wall 35. Typically, while corner portions may be lighted somewhat, with a conventional lens, generally the light distribution in these corner portions is week. However, light distribution with the lens L of the present invention is equally as strong in these corner portions of a room as it is in any area directly lighted by light passing through the other portions of the lens L.

One of the surprising discoveries of the present invention is the fact that occupants of a given environment such as a room in which the lens L of the invention is used, actually believe there is a much greater degree of light output. Tests have been conducted and occupants of a room have stated their belief that the light output is considerably greater with the lens L of the invention than with the prior art lens P. In fact, the lumen output used in these tests remain precisely the same. In effect, the occupants of a room or other lighted environment generally perceive of a more complete surrounding and presence of light when all portions of that room are lighted, than when only specific areas are lighted with direct light and the remaining portions lighted with reflected or indirect light.

The occupants of a room or other environment which is lighted with the lens of the present invention have also expressed a feeling of more peaceful and controlled lighting. Indeed, a lighting system utilizing the lens L of the invention effectively eliminates the possibility of glare but does not reduce the actual lumen output. In fact, while there is no increase of lumen output the occupants actually believe that there is such an increase.

The light diffusing lens of the invention has also been found to dramatically inhibit glare. Further, since there is substantially even light distribution, shadows have been virtually eliminated. As a result, softer light will exist at a work station. An unexpected but surprising result which has been observed in connection with the lens of the present invention is that there is actually an observable ostensible noise reduction. In fact, noise probably has not been reduced, although because of the fact that there is a much wider light distribution, there is a tendency for personnel in an environment to believe there is actually less noise. It is believed that sound will reflect or bounce off of a surface much in the same manner as a light wave. When sound bounces off of a flat plastic sheet, such as the prior art light diffusing panel, the sound can generate a sound similar to a bass drum. However, sound bouncing off of the lens L literally bounces off of panels at various angles. Consequently, occupants believe there is a reduction in noise levels. It is believed that the softer light, but with wider light distribution, in a room environment generally creates a more pleasant attitude on the part of the occupants and there may be a psychological belief associated with this improved lighting condition that noise level is also reduced.

Thus, there has been illustrated and described a unique and novel light diffusing lens which creates a very wide light distribution and reduces glare and localized hot spots but which achieves all of the objects and advances which have been sought therefore. It should be understood that many changes, modifications, variations and other uses and applications will become apparent to those skilled in the art after considering this specification and the accompanying drawings. Therefore, any and all such changes, modifications, variations and other uses and applications which do not depart from the spirit and scope of the invention are deemed to be covered by the invention which is limited only by the following claims.

Having thus described the invention, what I desire to claim and secure by letters patent is:

1. A light diffusing lens for disposition over a planar light dispensing opening of a light fixture having a source of light therein and providing a wide angled light distribution, said light diffusing lens comprising:

a) means for supporting said lens at an edge of the light fixture surrounding said opening, b) a somewhat vertically disposed first light translucent wall, extending outwardly from said supporting means and causing light to be directed at an angle substantially parallel to the plane of the light dispensing opening of said light fixture, c) a pair of inwardly inclined second light translucent walls connected to a pair of first edges of said first wall and being operatively connected together for causing light from the source of light to be directed both generally perpendicular to the plane of the light dispensing opening and at a substantial angle from the perpendicular to the plane of the light dispensing opening, and d) a pair of inwardly inclined third light translucent walls connected to a pair of second edges of said first wall and also being connected to said second wall, said second walls having substantially greater surface areas and substantially greater lengths along the first edges of said first wall than the length of the third walls along the second edges of said first wall, e) said second light translucent walls being connected together at their lower edges forming a single elongate edge with a length greater than the length of either of the second edges of the first wall so that the second walls are located at a substantial angle from a plane parallel to the light dispensing opening of the fixture, whereby light is directed at an angle of at least 180° in all directions from the fixture.

2. The light diffusing lens of claim 1 further characterized in that said second walls and said third walls are inclined at substantial angles to said plane of said light dispensing opening.

3. The light diffusing lens of claim 2 further characterized in that the outer edges of said second walls are connected together and form a single outermost edge of said lens, and that said third walls are connected to said second walls and to said single outermost edge.

4. The light diffusing lens of claim 1 further characterized in that the means for supporting said lens comprises a peripheral flange which is located so that it is generally parallel to the plane of the opening.

5. The light diffusing lens of claim 2 further characterized in that said light dispensing opening is generally rectangular in shape, said second walls are each generally trapezoidal in shape, and said third walls are generally triangular in shape.

6. A light diffusing lens for disposition over a downwardly facing light emitting opening of a light source means to provide a wide degree of light dispersion, said lens comprising:

a) supporting means for supporting said lens at the opening of said light source means and at a position where the supporting means does not extend appreciably below the downwardly facing opening, b) a somewhat vertically disposed first light translucent wall extending downwardly from said supporting means and with an upper edge of said first light translucent wall being approximately planar with the downwardly facing light opening so that light is directed horizontally and downwardly and upwardly from said light emitting opening, c) a plurality of inwardly converging second light translucent walls extending somewhat downwardly from said first light translucent wall and having upper edges connected to a lower edge of said first wall and lower edges which are joined to form a single elongate lower edge of said lens which is in a lowermost plane of the lens when in use and which thereby forms a fully closed lens when disposed at said light emitting opening, and d) a plurality of inwardly converging third light translucent walls having substantially lesser surface areas than said second walls and extending somewhat downwardly from said first wall and also having upper edges connected to a lower edge of said first wall, said third light translucent walls having lower end portions connected to said elongate lower edge of said lens.

7. The light diffusing lens of claim 6 further characterized in that said first wall and said second and third light translucent walls have a stippled outer surface.

8. The light diffusing lens of claim 6 further characterized in that said supporting means is a continuous peripherally extending generally horizontal lip.

9. The light diffusing lens of claim 6 further characterized in that said lens comprises a pair of said second walls which are connected together at outer edges of said second walls, and a pair of said third light translucent walls which are connected to said first wall and said second walls.

10. The light diffusing lens of claim 9 further characterized in that said second walls and said third walls are inclined at substantial angle to the plane of said light dispensing opening.

11. The light diffusing lens of claim 10 further characterized in that said third walls are connected to said second walls and to end portions of said single lowermost edge.

12. An improved light diffusing lens for disposition over the light dispensing opening of a light fixture, said light diffusing lens comprising:

a) a supporting means for supporting the lens at a fixture and, b) a first continuous generally peripheral somewhat vertically disposed light translucent wall extending around the periphery of said central opening and being comprised of a plurality of first wall sections, c) a pair of second orthagonally shaped light translucent walls extending from lower ends of a pair of said first wall sections and which pair of second light translucent walls are connected together at lower portions thereof, and d) a pair of third triangularly shaped light translucent walls extending from lower ends of other sections of said first wall and being connected to said second walls, each of said third walls having substantially lesser length than said second walls and having substantially lesser surface area than each of said second walls.

13. The improved light diffusing lens of claim 12 further characterized in that said supporting means is a peripherally extending lip, and said lip and said first wall are both rectangularly shaped.

14. A light diffusing lens for disposition over a downwardly facing light emitting opening of a light source means to provide a wide degree of light dispersion, said lens comprising:

a) supporting means for supporting said lens at the opening of said light source means and at a position where the supporting means does not extend appreciably below the downwardly facing opening, b) a first light translucent wall extending at least somewhat generally downwardly from said supporting means and with an upper edge of said first light translucent wall extending up to the downwardly facing light emitting opening so that light is directed horizontally and also in directions somewhat downwardly and upwardly from said light emitting opening, said light translucent first wall having a plurality of relatively long lower edges and a plurality of shorter lower edges, c) a plurality of inwardly converging first additional light translucent walls extending somewhat downwardly from the relatively long lower edges of said first light translucent wall at a different angle with respect to the perpendicular then said first wall and being connected to said relatively long lower edges of said first wall, and d) means connecting lower end portions of said first and second inwardly converging additional walls at an elongate single lowermost edge to form a closed lens when disposed at said light emitting opening and e) a plurality of inwardly convergent second additional light translucent walls extending somewhat downwardly from the shorter lower edges of said first light translucent wall at a different angle with respect to the perpendicular than said first wall and at a different angle with respect to the perpendicular than said first additional light translucent wall and which second additional walls are also connected to said relatively shorter lower edges of said first wall.

15. The light diffusing lens of claim 14 further characterized in that said first wall and said additional walls have a prismatic outer surface.

16. The light diffusing lens of claim 14 further characterized in that said means for supporting said lens is a peripherally extending lip.

17. A light diffusing lens for disposition over a downwardly facing light emitting opening of a light source means to provide a wide degree of light dispersion, said lens comprising:

a) supporting means for supporting said lens at the opening of said light source;

b) a pair of downwardly and inwardly converging light translucent side walls extending downwardly from said supporting means so that light can be directed horizontally and upwardly and downwardly from said side walls, c) a plurality of downwardly and inwardly converging light translucent end walls extending somewhat downwardly from said supporting means and having edges connected to said side walls so that light is also directed horizontally and downwardly and upwardly from said end walls, d) means connecting the lower ends of said side walls and end walls to form a closed lens when disposed at said light emitting opening, and e) means forming a plurality of non-linear rows of prisms on the outwardly presented surface of said side walls and said end walls and where the prisms are not all of the same size and shape.

18. The light diffusing lens of claim 17 further characterized in that the supporting means is located at a position where it is not located appreciably below the downwardly facing opening.

19. The light diffusing lens of claim 17 further characterized in that said second walls and said third walls are inclined at substantial angles to said plane of said light dispensing opening.

20. The light diffusing lens of claim 17 further characterized in that the entire outer surface of said side walls and said end walls have prisms thereon.

21. A light diffusing lens for disposition over a downwardly facing light emitting opening of a light source means to provide a wide degree of light dispersion, said lens comprising:

a) supporting means for supporting said lens at the opening of said light source means and at a position where the supporting means does not extend appreciably below the downwardly facing opening, b) a plurality of inwardly and downwardly directed light translucent walls extending somewhat downwardly from said supporting means and having upper edges, c) means connecting the lower edges of said light translucent walls to form a closed lens when disposed at said light emitting opening, and d) the light translucent walls having their entire outer surfaces provided with rows of prisms projecting outwardly from the outer surface of the walls, certain portions of the rows of the prisms being linerally arranged and certain portions of certain of the rows of prisms having arcuate shapes thereto so that the rows of prisms are not in a regular array, and certain of the prisms having regular equilateral surfaces and certain of the prisms having a distorted prism shape so that some of the sides of the prisms have a size greater than other sides of such prisms.

22. The light diffusing lens of claim 21 further characterized in that said lens comprises a somewhat vertically disposed first light translucent wall extending downwardly from said supporting means and with an upper edge of said first light translucent wall being approximately planar with the downwardly facing light opening so that light is directed horizontally and in directions generally downwardly and upwardly from said light emitting opening.

23. The light diffusing lens of claim 21 further characterized in that said lens is formed of an acrylic resin.

24. A light diffusing lens for disposition over a planar rectangularly shaped light dispensing opening of a light fixture having a source of light therein and providing a wide angled light distribution, said light diffusing lens comprising:

a) means for supporting said lens at an edge of the light fixture surrounding said opening, b) a somewhat vertically disposed first light translucent wall extending outwardly from said supporting means and causing light to be directed at an angle substantially parallel to the plane of the light dispensing opening of said light fixture, c) a pair of inwardly inclined trapezoidally shaped second light translucent walls connected to edges of said first wall and being operatively connected together at outer edges of said second walls for causing light from the source of the light to be directed both generally perpendicular to the plane of the light dispensing opening and at a substantial angle from the perpendicular to the plane of the light dispensing opening, d) said second light translucent walls being connected together at their lower outer edges forming a single outermost edge so that the second walls are located at a substantial angle from a plane parallel to the light dispensing opening of the fixture, whereby light is directed at an angle of at least 180° in all directions from the fixture, and e) a pair of triangularly shaped third light translucent walls inclined at substantial angles to the plane of the light dispensing opening, said third walls being connected to said first and second walls.

25. A light diffusing lens for disposition over a downwardly facing light emitting opening of a light source means to provide a wide degree of light dispersion, said lens comprising:

a) supporting means for supporting said lens at the opening of said light source means and at a position where the supporting means does not extend appreciably below the downwardly facing opening, b) a somewhat vertically disposed first light translucent wall extending downwardly from said supporting means and with an upper edge of said first light translucent wall being approximately planar with the downwardly facing light opening so that light is directed horizontally and downwardly and upwardly from said light emitting opening, c) a pair of inwardly converging second light translucent walls extending somewhat downwardly from said first light translucent wall and having upper edges connected to a lower edge of said first wall and lower outermost edges which are connected together to form a single lowermost edge of said lens, and d) a pair of inwardly converging third light translucent walls extending somewhat downwardly from said first light translucent wall, said third walls being inclined at substantial angles to the plane of the light emitting opening and being connected to said second walls and said lowermost edge to form a closed lens when disposed at said first emitting opening.

26. An improved light diffusing lens for disposition over the light dispensing opening of a light fixture, said light diffusing lens comprising:

a) a peripherally extending rectangularly shaped supporting lip for supporting the lens at a fixture and over the light dispensing opening, b) a first continuous generally peripheral somewhat vertically disposed light translucent wall extending around the periphery of said central opening and being comprised of a plurality of first wall sections, c) a pair of second trapezoidally shaped light translucent walls extending from lower ends of a pair of said first wall sections and which pair of second light translucent walls are connected together at lower portions thereof, and d) third triangularly shaped light translucent walls extending from lower ends of other sections of said first wall and being connected to said second walls.

27. A light diffusing lens for disposition over a downwardly facing light emitting opening of a light source means to provide a wide degree of light dispersion, said lens comprising:

a) supporting means for supporting said lens at the opening of said light source, b) a pair of downwardly and inwardly converging light translucent side walls extending downwardly from said supporting means so that light can be directed horizontally and upwardly and downwardly from said side walls, c) a plurality of downwardly and inwardly converging light translucent end walls extending somewhat downwardly from said supporting means and having edges connected to said side walls so that light is also directed horizontally and downwardly and upwardly from said end walls, d) means connecting the lower ends of said side walls and end walls to form a closed lens when disposed at said light emitting opening, and e) means forming a plurality of four-sided prisms on the outwardly presented surface of side walls and said end walls.

28. The light diffusing lens of claim 27 further characterized in that the entire outer surface of said side walls and said end walls have prisms thereon.

* * * * *